US010054064B2

(12) United States Patent
Tanaka et al.

(10) Patent No.: US 10,054,064 B2
(45) Date of Patent: Aug. 21, 2018

(54) ACTUATOR MOUNTING STRUCTURE FOR INTERNAL-COMBUSTION ENGINE HAVING VARIABLE COMPRESSION RATIO

(71) Applicant: NISSAN MOTOR CO., LTD., Yokohama-shi, Kanagawa (JP)

(72) Inventors: Yoshiaki Tanaka, Fujisawa (JP); Ryosuke Hiyoshi, Atsugi (JP); Yusuke Takagi, Hadano (JP); Katsutoshi Nakamura, Atsugi (JP)

(73) Assignee: NISSAN MOTOR CO., LTD., Yokohama-shi, Kanagawa (JP)

( * ) Notice: Subject to any disclaimer, the term of this patent is extended or adjusted under 35 U.S.C. 154(b) by 177 days.

(21) Appl. No.: 14/416,362

(22) PCT Filed: Jun. 3, 2013

(86) PCT No.: PCT/JP2013/065346
§ 371 (c)(1),
(2) Date: Jan. 22, 2015

(87) PCT Pub. No.: WO2014/017170
PCT Pub. Date: Jan. 30, 2014

(65) Prior Publication Data

US 2015/0176507 A1 Jun. 25, 2015

(30) Foreign Application Priority Data

Jul. 27, 2012 (JP) ..... 2012-166452

(51) Int. Cl.
*F02B 75/04* (2006.01)
*F02D 15/02* (2006.01)
(Continued)

(52) U.S. Cl.
CPC ..... *F02D 15/02* (2013.01); *F02B 75/04* (2013.01); *F02F 7/0068* (2013.01);
(Continued)

(58) Field of Classification Search
CPC ..... F02D 15/04; F02D 5/02; F02D 13/0269; F02B 75/04; F02B 2075/025
(Continued)

(56) References Cited

U.S. PATENT DOCUMENTS

2002/0020368 A1 2/2002 Fujimoto et al.
2006/0144354 A1* 7/2006 Tanaka ..... F02B 75/048 123/48 B
2010/0006069 A1* 1/2010 Yoshikawa ..... F02D 15/02 123/48 B

FOREIGN PATENT DOCUMENTS

EP 1 178 194 A2 2/2002
EP 2 063 084 A1 5/2009
(Continued)

*Primary Examiner* — Jacob Amick
*Assistant Examiner* — Charles Brauch
(74) *Attorney, Agent, or Firm* — Drinker Biddle & Reath LLP

(57) ABSTRACT

An actuator mounting structure of a variable compression ratio internal combustion engine includes: a variable compression ratio mechanism arranged to vary an engine compression ratio in accordance with a rotational position of a control shaft; an actuator arranged to drivingly rotate the control shaft, the actuator being fixed on an actuator mounting portion provided to a side wall of a main body of the engine by using a plurality of fixing bolts, and a rigidity improvement section arranged to improve a mounting rigidity of the actuator to the actuator mounting portion, and which is provided within an inter-bolt distance between two bolts of the plurality of the fixing bolts, which are located on the both sides in a direction of a crank shaft.

7 Claims, 6 Drawing Sheets

(51) Int. Cl.

| | |
|---|---|
| ***F02F 7/00*** | (2006.01) |
| *F02B 75/02* | (2006.01) |
| *F02D 15/04* | (2006.01) |
| *F02D 13/02* | (2006.01) |
| *F01M 11/00* | (2006.01) |

(52) U.S. Cl.
CPC ..... *F01M 11/0004* (2013.01); *F02B 75/048* (2013.01); *F02B 2075/025* (2013.01); *F02D 13/0269* (2013.01); *F02D 15/04* (2013.01)

(58) Field of Classification Search
USPC ..... 123/48 R
See application file for complete search history.

(56) References Cited

FOREIGN PATENT DOCUMENTS

| | | | |
|---|---|---|---|
| JP | 4062867 | B2 | 3/2008 |
| JP | 2008-088889 | A | 4/2008 |
| JP | 2011-220311 | A | 11/2011 |
| JP | 2012-102713 | A | 5/2012 |
| WO | WO 01/92700 | A1 | 12/2001 |
| WO | WO-2008/032439 | A1 | 3/2008 |

* cited by examiner

ACTUATOR MOUNTING STRUCTURE FOR INTERNAL-COMBUSTION ENGINE HAVING VARIABLE COMPRESSION RATIO

TECHNICAL FIELD

This invention relates to an internal combustion engine including a variable compression ratio mechanism, and more specifically to an art to improve a rigidity of an actuator case mounted to a side wall of a main body of the engine.

BACKGROUND ART

An actuator arranged to drive a control shaft of a variable compression ratio mechanism is mounted to a side wall of an upper oil pan fixed to a lower portion of a cylinder block by using a plurality of fixing bolts, for example, as shown in a patent document 1. As one example of a mounting structure in which the actuator is mounted to the side wall of the main body of the engine, a patent document 2 discloses a structure in which an actuator of a variable valve actuating device is fixed on both (to extend across) two components of an upper head and a lower head.

PRIOR ART DOCUMENT

Patent Document

Patent Document 1: Japanese Patent Application Publication No. 2012-102713

Patent Document 2: Japanese Patent Application Publication No. 2011-220311

SUMMARY OF THE INVENTION

Problems which the Invention is Intended to Solve

An actuator mounting portion provided to the side wall of the main body of the engine needs a very high rigidity since a combustion load and an inertia load which are greater than those of a piston-crank mechanism side that is a main moving system is repeatedly-acted to an actuator of the variable compression ratio mechanism. However, when the actuator is fixed on both the side walls of the two components like the patent document 2, the side walls of the two components need to be accurately formed to be flush with each other to ensure the sealing characteristic, it's processing working is difficult, so that it is not possible to avoid the cost increase.

It is, therefore, an object of the present invention to improve a mounting rigidity of an actuator of a variable compression ratio mechanism to an engine main body for dissolving the above-described problems.

Means for Solving the Problem

There is provided a variable compression ratio mechanism arranged to vary an engine compression ratio in accordance with a rotational position of a control shaft, and an actuator arranged to drivingly rotate the control shaft. The actuator is fixed to an actuator mounting portion provided to a side wall of a main body of the engine by using a plurality of fixing bolts. There is provided a rigidity improvement section which improves a mounting rigidity of the actuator to the actuator mounting portion, and which is disposed within an inter-bolt distance between two fixing bolts of the plurality of the fixing bolts, which are positioned on the both sides in the direction of the crank shaft.

As one example of the rigidity improvement section, for example, an upper oil pan lower surface side flange portion to which a lower oil pan is fixed is provided on a lower surface side of the upper oil pan to which the actuator mounting portion is provided. A part of this flange portion is positioned within the inter-bolt distance, so as to constitute the first rigidity improvement section which is one of the rigidity improvement section.

Moreover, a bolt boss portion through which a bolt for fixing the cylinder block and the upper oil pan that are provided with the actuator mounting portion are positioned within the inter-bolt distance, so as to constitute a second rigidity improvement section which is one of the rigidity improvement section.

Benefit of the Invention

By the present invention, the rigidity improvement section is provided within the inter-bolt distance between the plurality of the bolts for mounting the actuator to the actuator mounting portion, in the direction of the cylinder shaft. With this, it is possible to improve the mounting rigidity of the actuator of the variable compression ratio mechanism to the engine main body. Moreover, it is possible to improve the accuracy of the positioning of the link member, and to improve the accuracy of the compression ratio control.

DESCRIPTION OF EMBODIMENTS

Figure 1:
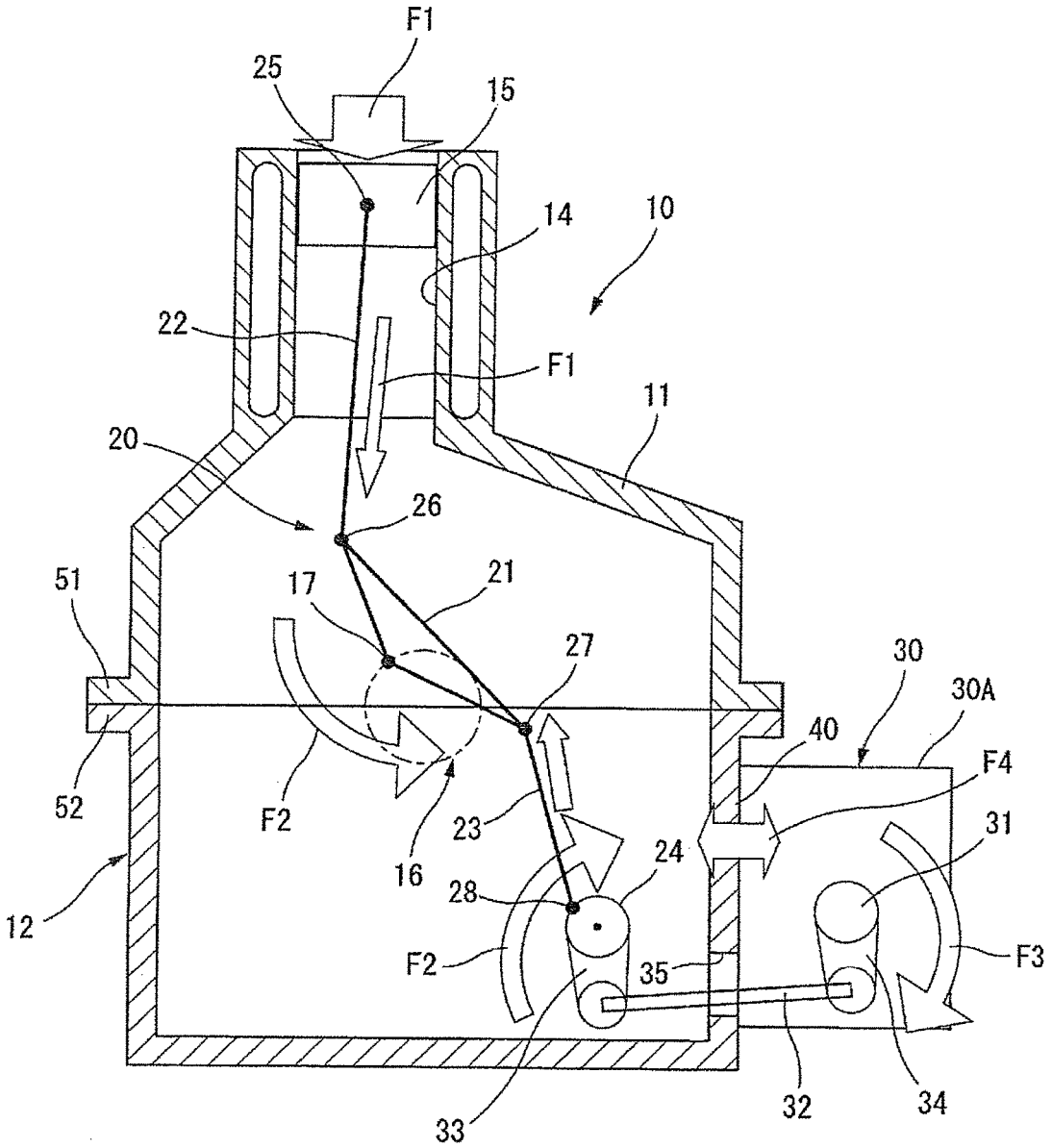
FIG. 1 is a configuration view schematically showing a variable compression ratio internal combustion engine according to one embodiment of the present invention.

Hereinafter, the present invention is illustrated with reference to an embodiment shown in the drawings. With reference to FIG. 1, an upper oil pan 12 constituting an upper section of an oil pan is fixed to a lower portion of a cylinder block 11 of an internal combustion engine 10. An lower oil pan (not shown) constituting a lower section of the oil pan is fixed so as to close a lower surface opening portion which is formed and opened on a lower surface side of the upper oil pan 12, as described later. A piston 15 is disposed to each of cylinders of a cylinder block 11 to be reciprocated. This piston 15 and a crank shaft 16 are connected by a variable compression ratio mechanism 20 which uses a multi-link piston-crank mechanism. Besides, in FIG. 1, for simplification, only link center lines of link components constituting the variable compression ratio mechanism 20 are schematically drawn.

This variable depression ratio mechanism 20 are known as described in the above-described Japanese Patent Application Publication No. 2012-102713. This can be simply explained as follows. This variable compression ratio mechanism 20 includes a lower link 21 rotatably mounted to a crank pin 17 of the crank shaft 16; an upper link 22 connecting the lower link 21 and a piston 15; and a control link 23 connecting the lower link 21 and a control shaft 24. The piston 15 and an upper end of the upper link 22 are connected with each other by a piston pin 25 to be rotated relative to each other. The lower link 21 and a lower end of the upper link 22 are connected with each other by a first connection pin 26 to be rotated relative to each other. The lower link 21 and an upper end of the control link 23 are connected with each other by a second connection pin 27 to be rotated relative to each other. The control shaft 24 is rotatably supported within the upper oil pan 12 which is an engine main body. A lower end of the control link 23 is rotatably mounted to an eccentric shaft portion 28 which is eccentric from a center of the control shaft 24.

The control shaft 24 is rotatably driven by an actuator 30. This actuator 30 varies a rotational position of the control shaft 24. With this, a movement restriction condition of the lower link 21 by the control link 23 is varied by the variation of the position of the rotational position of the control shaft 24 by this actuator 30, so that a piston stroke characteristic including a top dead center and a bottom dead center of the piston 15 is varied. With this, the engine compression ratio is continuously varied. Accordingly, the operation of the actuator 30 is controlled in accordance with an operating state of the engine, so that the engine compression ratio can be continuously varied.

The actuator 30 is a member which receives and unitizes, within an actuator case 30A, a speed reduction device, and an actuator main body such as an electric motor or a hydraulic pressure mechanism. The actuator 30 is fixed to an actuator mounting portion 40 provided integrally with a side wall of the upper oil pan 12 on the suction side, by being tightened by a plurality of fixing bolts (not shown). A connection mechanism connecting this control shaft 24 and an output shaft 31 of the actuator 30 is provided with a lever 32 inserted into a slit 35 formed in the actuator mounting portion 40 to penetrate through the actuator mounting portion 40. One end of this lever 32 is connected to a tip end of a first arm portion 33 extending in the radial direction from a center of the rotation of the control shaft 24. The other end of the lever 32 is connected to a tip end of a second arm portion 34 extending in the radial direction from the center of the rotation of the output shaft 31 of the actuator 30.

In the variable compression ratio mechanism which is a main moving mechanism, and which uses a multi-link type piston-crank mechanism, large combustion load F1 and inertia load are repeatedly acted to that actuator 30. The combustion load F1 acted to the piston 15 is converted to a rotational torque F2 of the control link 24 through the upper link 22, the lower link 21 and the control link 23. This rotational torque F2 is acted as a rotational torque F3 of the output shaft 31 of the actuator 30 through the lever 32 and so on. The output shaft 31 of the actuator 30 is rotatably supported by bearing portions of the case 30A of the actuator 30. Accordingly, a load component other than the rotational torque F3 is mainly acted, as a load F4 in a direction perpendicular to the mounting surface of the actuator mounting portion 40, through the actuator case 30A to the actuator mounting portion 40 of the side wall of the upper oil pan 12. Consequently, the actuator mounting portion 40 needs the high rigidity with respect to the load F4.

Therefore, in this embodiment, the actuator mounting portion 40 includes two rigidity improvement sections 41 and 42 so as to obtain high rigidity which can resist the input of that load F4. The concrete structures of these actuator mounting portion 40 and the rigidity improvement sections 41 and 42 are illustrated in detail with reference to FIGS. 2-6.

Figure 2:
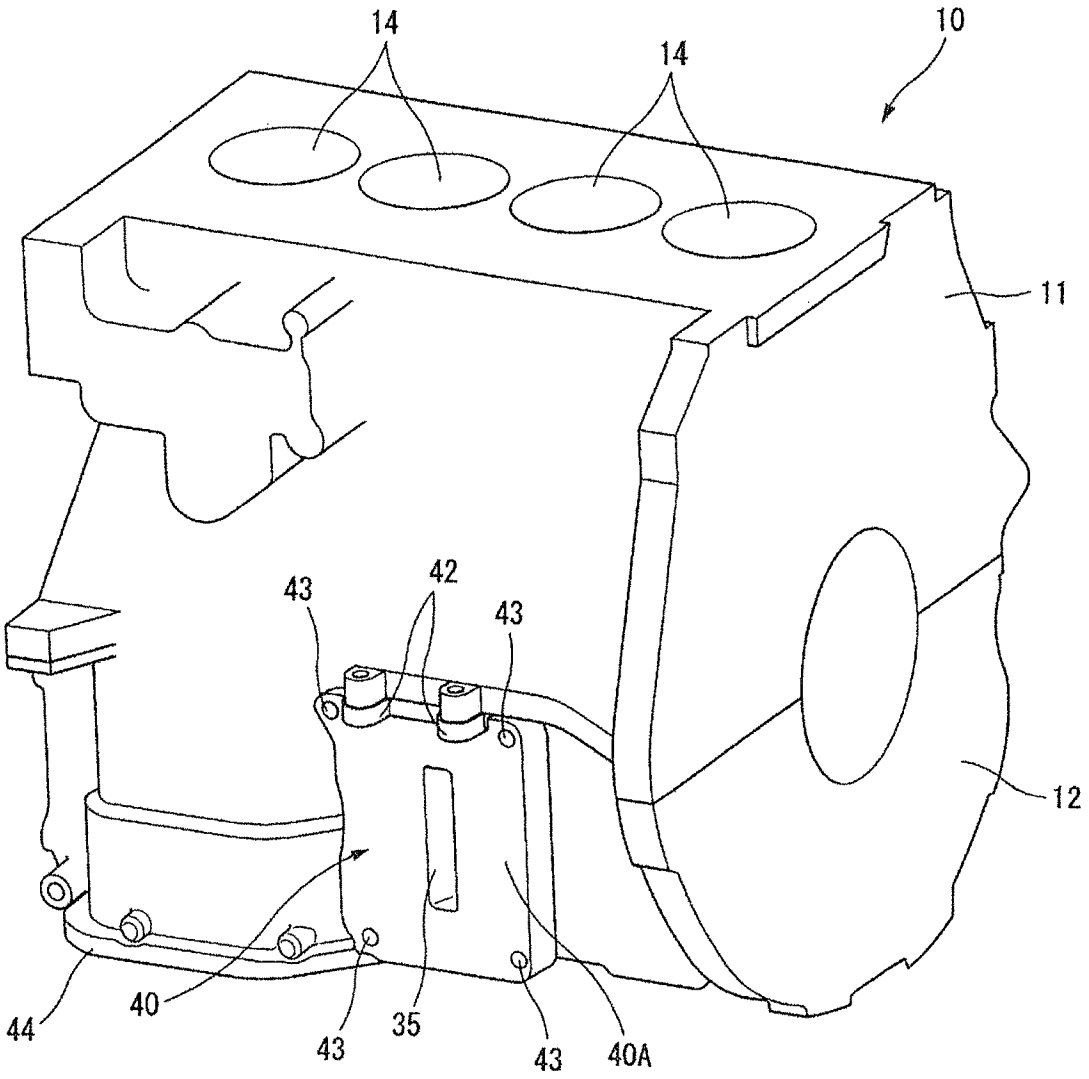
FIG. 2 is a perspective view showing an actuator mounting structure according to the present embodiment.
Figure 3:
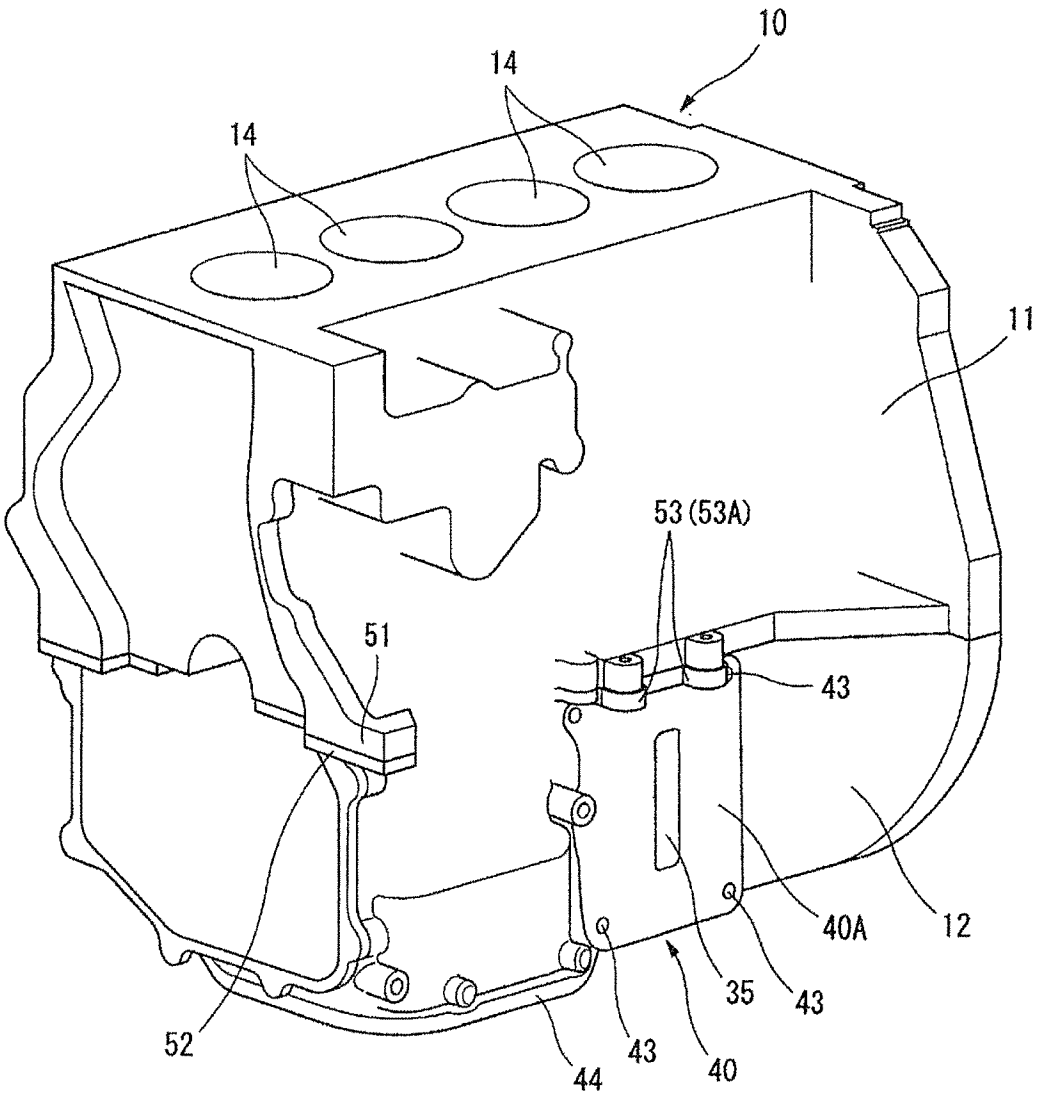
FIG. 3 is a perspective view showing the actuator mounting structure according to the present embodiment.

The actuator mounting portion 40 is formed integrally with the side wall of the upper oil pan 12 on the suction side, which is casted from an appropriate metal material such as aluminum alloy. As shown in FIG. 2, the actuator mounting portion 40 has a thick rectangular plate shape which has a predetermined thickness, and which partially protrudes from the side wall of the upper oil pan 12. The mounting surface 40A of the actuator mounting portion 40 to which the actuator 30 is liquid-tightly fixed is processed into a flat surface. This actuator mounting portion 40 includes four bolt holes 43 which are formed at four corners of this actuator mounting portion 40, and to which fixing bolts for tightening and fixing the actuator 30 are screwed. Moreover, the actuator mounting portion 40 includes a slit 35 which is formed at a central portion of the actuator mounting portion 40 to penetrate through the actuator mounting portion 40, and through which the above-described lever 32 is inserted. Furthermore, the actuator mounting portion 40 includes an oil hole (not shown) which penetrates through the actuator mounting portion 40, and which is arranged to supply and discharge the lubrication oil. The lubrication oil is supplied and discharged through these oil holes and the above-described slit 35 between the inside of the oil pan and the inside of the actuator 30.

Figure 4:
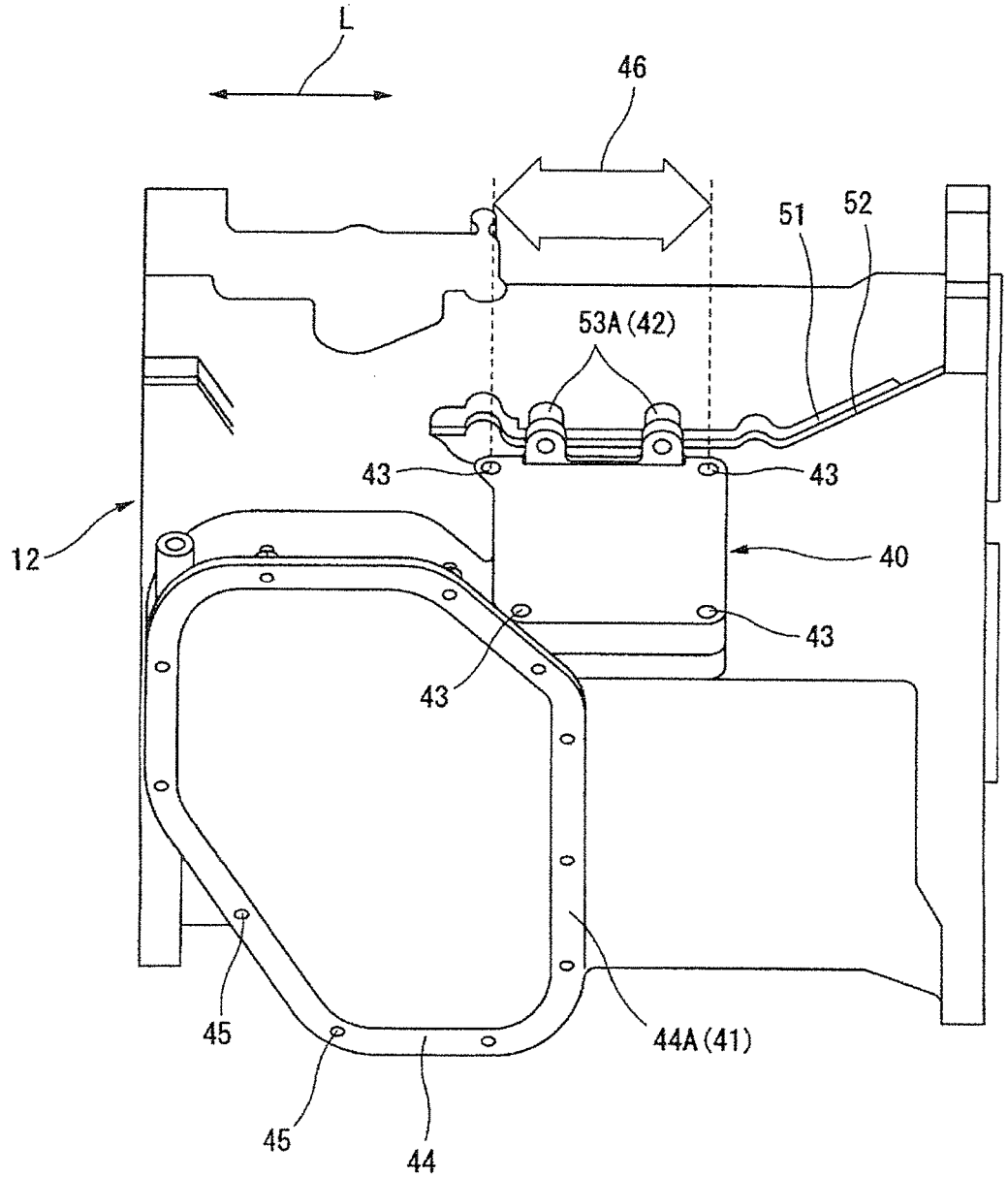
FIG. 4 is a perspective view of an upper oil pan to which the actuator mounting structure according to this embodiment is applied when the upper oil pan is viewed from an diagonally lower direction.

The upper oil pan 12 includes an upper oil pan lower surface side flange portion 44 which is formed at a peripheral portion of an opening on the lower surface side, and to which the lower oil pan is mounted so as to close this opening peripheral portion. As shown in FIG. 4, this upper oil pan lower surface side flange portion 44 has a belt shape having a predetermined thickness. A plurality of lower oil pan mounting bolt holes 45 into which the lower oil pan mounting bolts are inserted are formed in this upper oil pan lower surface side flange portion 44 at appropriate intervals.

A part of the upper oil pan lower surface side flange portion 44, in particular, a side portion 44A of the upper oil pan lower surface side flange portion 44 which extends in a widthwise direction of the engine as shown in FIG. 4 is disposed to be overlapped with the actuator mounting portion 40 in the crank shaft direction L. That is, the side portion 44A which is a portion of the upper oil pan lower surface side flange portion 44 is set to be disposed in a range of an inter-bolt distance 46 between two bolts (bolt holes 43) positioned at both ends in the crank shaft direction L, of the plurality of the fixing bolts (bolt holes 43) which fix the actuator 30 to the actuator mounting portion 40.

Figure 5:
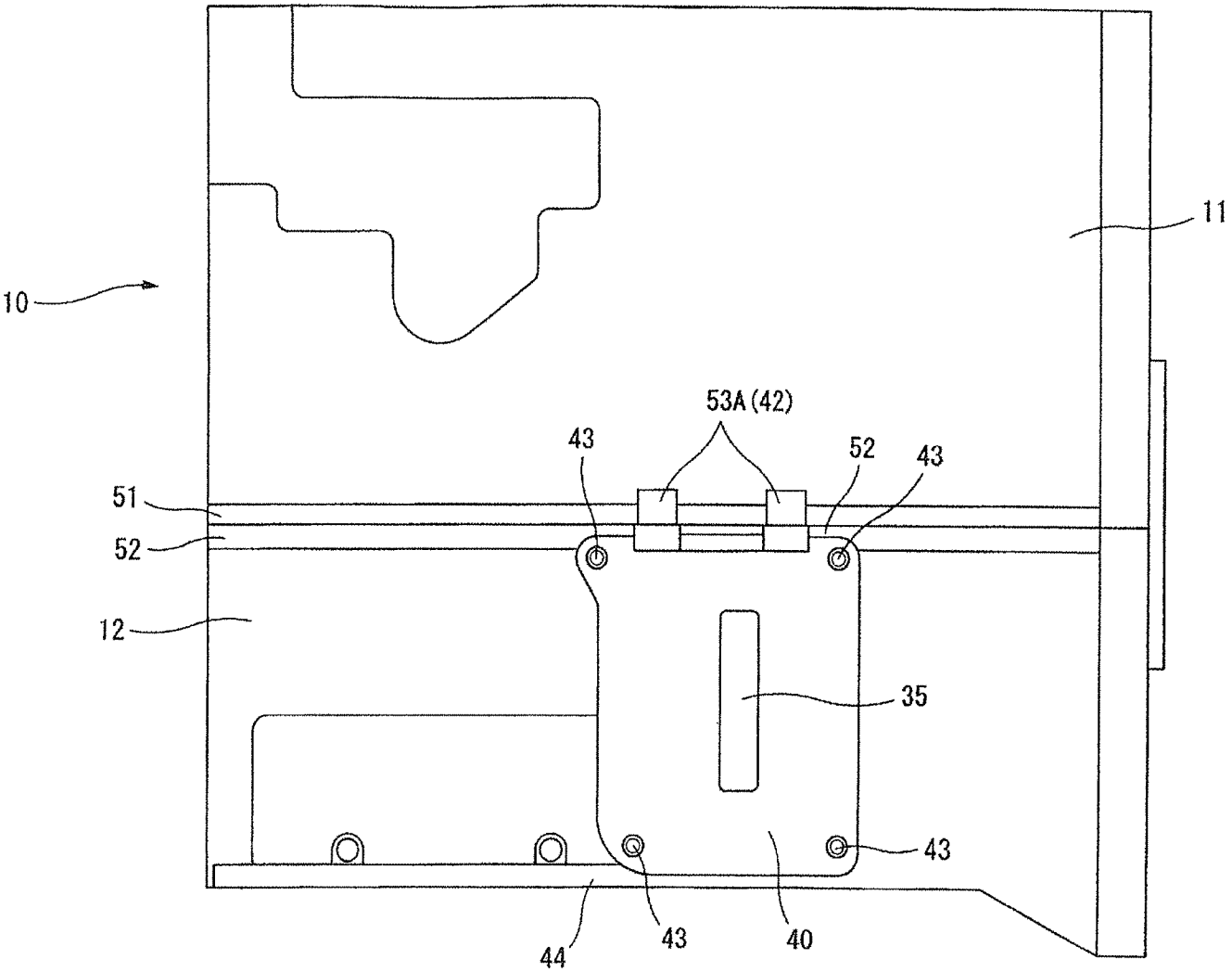
FIG. 5 is a side view showing the actuator mounting structure according to the present embodiment.

Moreover, as shown in FIG. 5, the lower end portion of the actuator mounting portion 40 is disposed so as to be partially overlapped with the upper oil pan lower surface side flange portion 44, in the upward and downward directions of the engine (the upward and downward directions of FIG. 5). Accordingly, the side portion 44A of the upper oil pan lower surface side flange portion 44 is substantially connected with the actuator mounting portion 40, as shown in FIG. 4. The side portion 44A of the upper oil pan lower surface side flange portion 44 has a beam structure extending from this actuator mounting portion 40 in the widthwise direction of the engine. The side portion 44A of the upper oil pan lower surface side flange portion 44 constitutes a first rigidity improvement section 41 which improves the mounting rigidity of the actuator mounting portion 40, in particular, the lower portion of the actuator mounting portion 40. That is, this first rigidity improvement section 41 serves as adding a rib extending in the widthwise direction (the leftward and rightward directions), to the lower side portion of the actuator mounting portion 40. With this, it is possible to largely improve the rigidity of the actuator mounting portion 40 in the widthwise direction of the engine.

Figure 6:
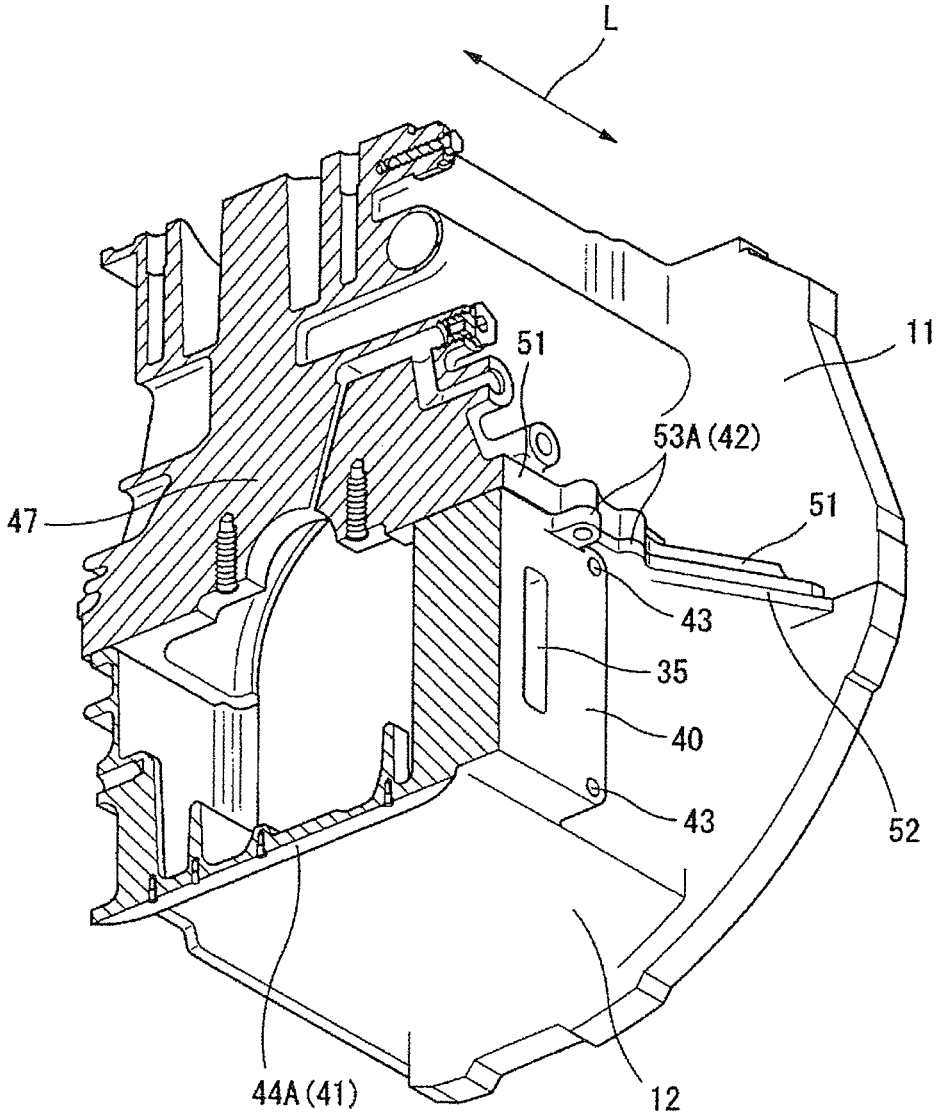
FIG. 6 is a partially-breakaway perspective view showing the actuator mounting structure according to the present embodiment.

Moreover, the cylinder block 11 is provided with a plate-shaped bulk wall 47 which is disposed between adjacent cylinders 14, as shown in FIG. 6. The side portion 44A of the upper oil pan lower surface side flange portion 44 serving as the first rigidity improvement section 41 is disposed so that the position thereof corresponds to the position of the bulk wall 47 in the crank shaft direction L. With this, as shown in a sectional view of FIG. 6, in the sectional surface perpendicular to the crank shaft direction L, a structure of the rectangular beam shape having the closed section surface is formed by the bulk wall 47 of the cylinder block 11, the side wall of the upper oil pan 12 including the oil pan mounting portion 40, and the one side portion 44A (the first rigidity improvement section 41) of the upper oil pan lower surface side flange portion 44. With this, it is possible to largely improve the rigidity of the actuator mounting portion 40.

Next, a second rigidity improvement section 42 is illustrated. As shown in FIG. 4 to FIG. 6, a cylinder block lower surface side flange portion 51 which has a predetermined thickness, and which protrudes radially outwards is formed integrally on the peripheral portion of the opening of the lower surface side of the cylinder block 11. Moreover, an upper oil pan upper surface side flange portion 52 which has a predetermined thickness, and which protrudes radially outwards is integrally formed on the peripheral portion of the opening on the upper surface side of the upper oil pan 12. A plurality of bolt boss portions 53 for fixing together by the fixing bolts are formed at appropriate intervals, to these cylinder block lower surface side flange portion 51 and the upper oil pan upper surface side flange portion 52. These bolt boss portions 53 have thick shapes which protrude in the semi-arc shape from the flange portions 51 and 52, so as to have a rigidity locally higher than those of the normal portion (the general portion) of the flange portions 51 and 52.

As shown in FIG. 4, adjacent two of bolt boss portions 53A of these plurality of the bolt boss portions 53 are disposed within the inter-bolt distance 46 of the above-described actuator mounting portion 40 in the crank shaft direction L. Moreover, as shown in FIG. 5, the upper end portion of the actuator mounting portion 40 is disposed near the upper oil pan upper surface side flange portion 52 in the upward and downward directions of the engine. Accordingly, the two bolt boss portions 53A disposed within the inter-bolt distance 46 is substantially continuous with the actuator mounting portion 40. These two bolt boss portions 53A serve as the second rigidity improvement section 42 arranged to improve the rigidity of the actuator mounting portion 40, in particular, the upper side portion of the actuator mounting portion 40.

The operations and effects of this structure according to the embodiment are illustrated below. As in the conventional art, when the actuator mounting portion are set on both the two components of the cylinder block 11 and the upper oil pan 12, and the actuator is fixed to this portion, the mounting rigidity is improved. However, when the slit 35 and the oil hole are formed in the actuator mounting portion, it is extremely difficult to secure that sealing characteristic. In this embodiment, the actuator mounting portion 40 is set only in the one component of the upper oil pan 12. With this, the mounting surface 40A of the actuator mounting portion 40 having the predetermined thickness is readily processed into the flat surface at the accuracy. With this, the sealing characteristic is readily ensured by mounting the actuator 30 through an appropriate sealing member (not shown) to the mounting surface 40A.

However, when the actuator mounting portion 40 is set only to the upper oil pan 12 in this way, it is a large problem to ensure the rigidity of the actuator mounting portion 40, in particular, to ensure the rigidity with respect to the load F4 (cf. FIG. 1) in a direction perpendicular to the mounting surface 40A. However, in this embodiment, there are provided the above-described two rigidity improvement sections 41 and 42. With this, it is possible to ensure the rigidity of the actuator mounting portion 40, and to ensure both the sealing characteristic and the rigidity of the actuator mounting portion 40. In this way, the position accuracy of the link components is improved by improving the rigidity of the actuator mounting portion 40. Moreover, the accuracy of the compression ratio variable control is improved. Furthermore, the strength and the durability of the actuator mounting portion 40 is improved.

In particular, in this embodiment, the rigidity of the lower side portion of the actuator mounting portion 40 is improved by the side portion 44A of the upper oil pan lower surface side flange portion 44 serving as the first rigidity improvement section 41. The rigidity of the upper side portion of the actuator mounting portion 40 is improved by the two bolt boss portions 53A serving as the second rigidity improvement section 42. With this, it is possible to improve the rigidity in the well-balanced manner all over the total length of the engine in the upward and downward directions. Moreover, this structure uses the existing flange portion and the existing bolt boss portion. Accordingly, it is unnecessary to set other thick portions and so on for improving the rigidity. Therefore, it is possible to simplify the shape, and to decrease the weight.

Moreover, in this embodiment, for further improving the rigidity, the interval (pitch) of the two bolt boss portions 53A positioned within this inter-bolt distance 46 is set smaller than the interval (pitch) of the other bolt boss portions 53 disposed in the portion other than this actuator mounting portion 40, so that adjacent (two) of the bolt boss portions 53A are disposed within this inter-bolt distance 46 of the actuator mounting portion 40.

Hereinbefore, the present invention is illustrated based on the concrete embodiment. However, the present invention is not limited to the above-described embodiment. The present invention may include the various variations and modifications. For example, in the embodiment, the actuator mounting portion is provided to the side wall on the intake side to avoid the side wall of the exhaust side which is the high temperature. However, the actuator mounting portion may be provided to the side wall of the exhaust side. Moreover, the plurality of the bolt boss portions 53A serving as the second rigidity improvement section 42 is disposed within the inter-bolt distance 46. However, only one bolt boss portion may be disposed.

The invention claimed is:

1. An actuator mounting structure of a variable compression ratio internal combustion engine, the actuator mounting structure comprising:

a variable compression ratio mechanism arranged to vary an engine compression ratio in accordance with a rotational position of a control shaft;

an actuator arranged to drivingly rotate the control shaft, the actuator being fixed on an actuator mounting portion which is provided to a side wall of a main body of the engine, and which extends in a direction of a crank shaft, by using a plurality of fixing bolts, and a rigidity improvement section arranged to improve a mounting rigidity of the actuator to the actuator mounting portion, and which is provided within an inter-bolt distance between two bolts of the plurality of the fixing bolts, the two bolts being located on both sides of the actuator mounting portion in the direction of the crank shaft by one of the two bolts being disposed at a first position along a length of the crank shaft, another of the two bolts being disposed at a second position along the length of the crank shaft, and the first position and the second position being spaced apart, wherein the actuator mounting portion is provided to a side wall of an upper oil pan fixed to a lower portion of a cylinder block; a lower oil pan is fixed to an upper oil pan lower surface side flange portion which is formed on a lower surface side of the upper oil pan; and a side portion of the upper oil pan lower surface side flange portion which extends in a widthwise direction of the engine that is perpendicular to the direction of the crank shaft is positioned within the inter-bolt distance so as to constitute a first rigidity improvement section of the rigidity improvement section.

2. The actuator mounting structure for the variable compression ratio internal combustion engine as claimed in claim 1, wherein the actuator mounting structure further comprises a bulk wall provided between adjacent cylinders of the cylinder block; and the first rigidity improvement section is disposed so that a position of the first rigidity improvement section corresponds to a position of the bulk wall in the direction of the crank shaft.

3. The actuator mounting structure for the variable compression ratio internal combustion engine as claimed in claim 1, wherein the actuator mounting portion is provided to a side wall of the upper oil pan fixed to a lower portion of the cylinder block; and a bolt boss portion into which a bolt for fixing the upper oil pan and the cylinder block is inserted is positioned within the inter-bolt distance, so as to constitute a second rigidity improvement section of the rigidity improvement section.

4. The actuator mounting structure for the variable compression ratio internal combustion engine as claimed in claim 3, wherein a plurality of bolt boss portions constituting the second rigidity improvement section are provided within the inter-bolt distance.

5. The actuator mounting structure for the variable compression ratio internal combustion engine as claimed in claim 1, wherein the actuator mounting structure further comprises a connection mechanism connecting the actuator and the control shaft; and the connection mechanism includes a lever which passes through a slit that is formed in the actuator mounting portion, and that penetrates through the actuator mounting portion.

6. The actuator mounting structure for the variable compression ratio internal combustion engine as claimed in claim 1, wherein the variable compression ratio mechanism includes a lower link rotationally mounted to a crank pin of the crank shaft, an upper link connecting the lower link and a piston, and a control link having one end connected to the lower link; and the other end of the control link is rotationally mounted to an eccentric shaft portion of the control shaft.

7. The actuator mounting structure for the variable compression ratio internal combustion engine as claimed in claim 1, wherein the actuator mounting portion is provided to a side wall of the main body of the engine on an intake side.

* * * * *